US006484710B1

(12) United States Patent
Summers et al.

(10) Patent No.: US 6,484,710 B1
(45) Date of Patent: Nov. 26, 2002

(54) ARCHERY FINGER TRIGGER RELEASE WITH COCKING SLIDE

(75) Inventors: Gregory E. Summers, 105 Overlink Dr., Lynchburg, VA (US) 24503; Marc T. Rentz, Madison Heights, VA (US)

(73) Assignee: Gregory E. Summers, Lynchburg, VA (US)

( * ) Notice: Subject to any disclaimer, the term of this patent is extended or adjusted under 35 U.S.C. 154(b) by 0 days.

(21) Appl. No.: 09/773,894

(22) Filed: Feb. 2, 2001

(51) Int. Cl.[7] ..... F41B 5/18
(52) U.S. Cl. ..... 124/35.2
(58) Field of Search ..... 124/35.2

(56) References Cited

U.S. PATENT DOCUMENTS

| | | | | |
|---|---|---|---|---|
| 2,488,597 | A | 11/1949 | Konold | |
| 2,637,311 | A | 5/1953 | Rose | |
| 2,819,707 | A | 1/1958 | Kayfes et al. | |
| 2,965,093 | A | 12/1960 | Arsenault | |
| 4,009,703 | A | 3/1977 | Cunningham, Sr. | |
| 4,134,369 | A | 1/1979 | Cook | |
| 4,151,825 | A | 5/1979 | Cook | |
| 4,282,851 | A | 8/1981 | Lyons | |
| 4,509,497 | A | 4/1985 | Garvison | |
| 4,539,968 | A | 9/1985 | Garvison | |
| 4,791,908 | A | 12/1988 | Pellis | |
| 4,831,997 | A | 5/1989 | Greene | |
| 4,881,516 | A | 11/1989 | Peck | |
| 4,926,835 | A | 5/1990 | Peck | 124/35.2 |
| 4,981,128 | A | 1/1991 | Garvison | 124/35.2 |
| 5,020,508 | A | 6/1991 | Greene, Jr. | 124/35.2 |
| 5,070,854 | A | 12/1991 | Peck | 124/35.2 |
| 5,078,116 | A | 1/1992 | Peck | 124/35.2 |
| 5,103,796 | A | 4/1992 | Peck | 124/35.2 |
| 5,247,921 | A | 9/1993 | Todd | 124/35.2 |
| 5,357,939 | A | 10/1994 | Tentler et al. | 124/35.2 |
| 5,370,102 | A | 12/1994 | Peck | 124/35.2 |
| 5,615,662 | A | 4/1997 | Tentler et al. | 124/35.2 |
| 5,680,851 | A | 10/1997 | Summers | 124/35.2 |
| 5,685,286 | A | 11/1997 | Summers | 124/35.2 |
| 5,694,915 | A | 12/1997 | Summers | 124/35.2 |
| 5,937,842 | A | 8/1999 | Summers | 124/35.2 |
| 6,205,991 | B1 | 3/2001 | Summers et al. | 124/35.2 |

*Primary Examiner*—John A. Ricci
(74) *Attorney, Agent, or Firm*—Nixon & Vanderhye P.C.

(57) ABSTRACT

A bowstring release includes a main body portion; a pair of jaws pivotably mounted within the housing for movement between closed and open positions; a piston and firing pin assembly slidably mounted in the housing and biased in a firing direction by a first spring, the piston and firing pin assembly operatively connected to the jaws; a cocking slide mounted for sliding movement along a top surface of the housing, the cocking slide engageable with the piston for moving the piston to a cocked position; a sear pivotably mounted within the housing, one end of which is engageable with the piston; and a trigger pivotably mounted in the housing, the trigger having a projection engageable with an opposite end of the sear; the sear biased against the projection in a non-firing direction by a second spring; the projection, when the trigger is pulled, moving the sear in a firing direction to enable the one end to disengage the piston and thereby permit the piston and firing pin assembly to move forward in a firing direction to cause the jaws to move to the open position.

16 Claims, 6 Drawing Sheets

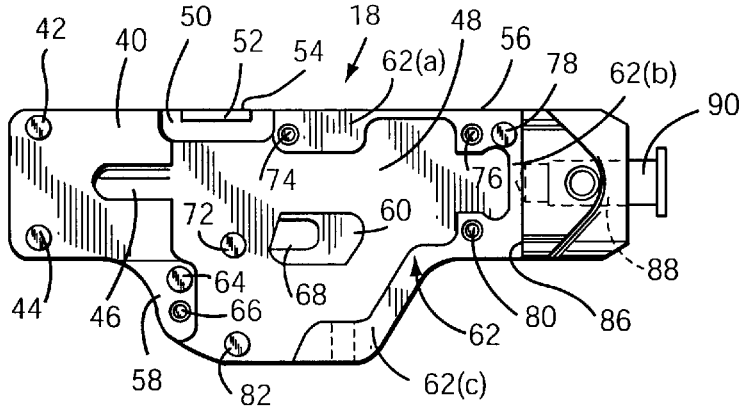
Fig. 2
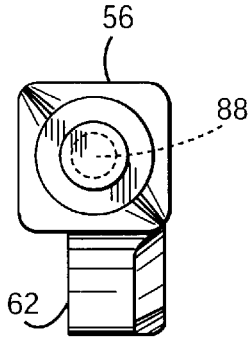
Fig. 3
Fig. 4
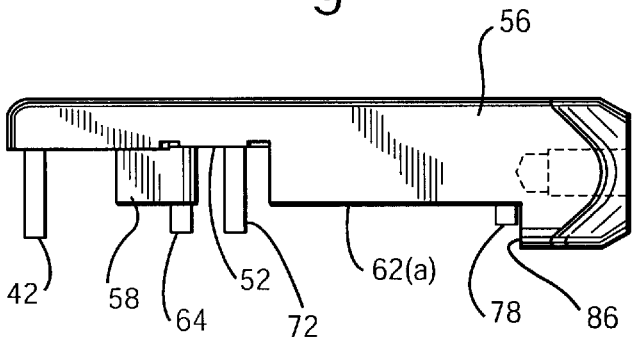

Fig. 8
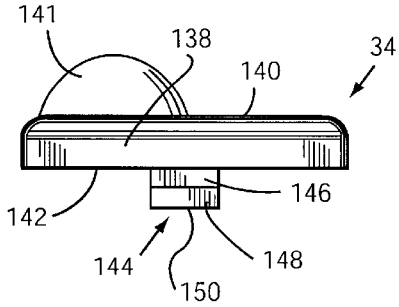
Fig. 9
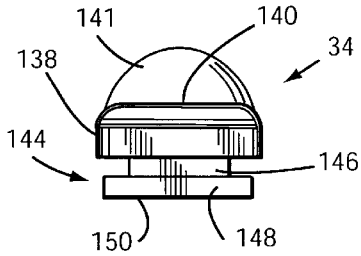
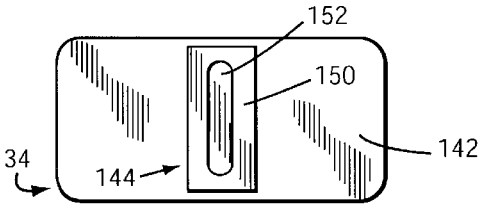
Fig. 10
Fig. 11
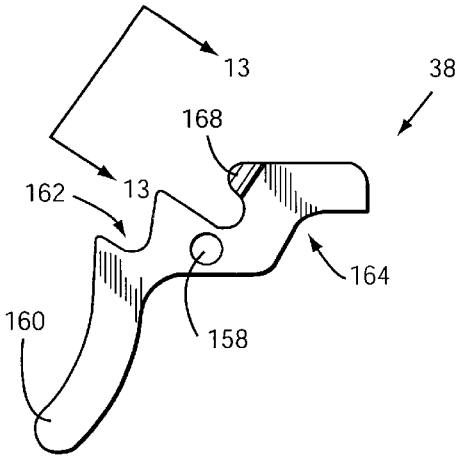
Fig. 12
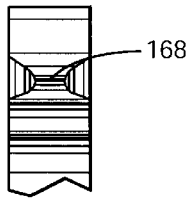

Fig. 13
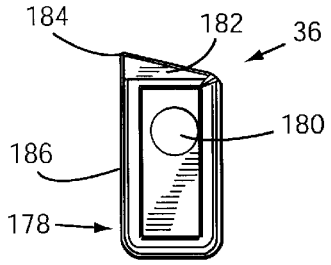
Fig. 14
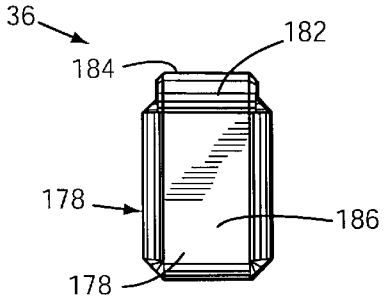
Fig. 15
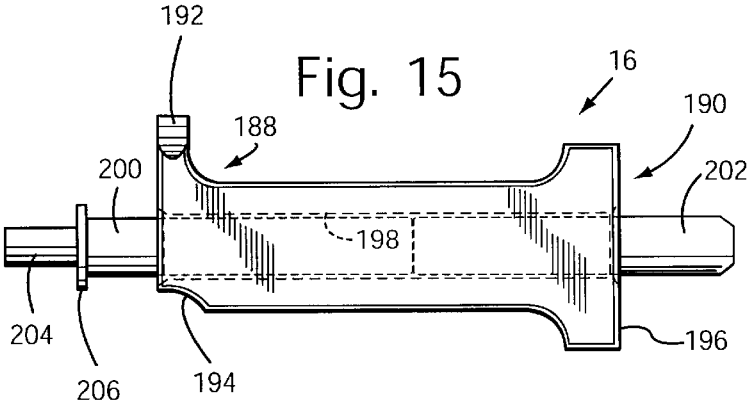
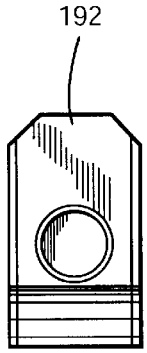
Fig. 16
Fig. 17
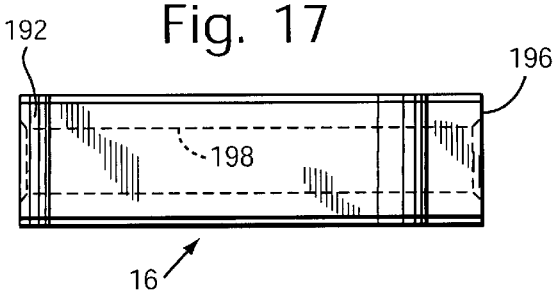

ARCHERY FINGER TRIGGER RELEASE WITH COCKING SLIDE

The present invention relates to bowstring release devices, and more specifically, an index finger trigger release incorporating a cocking slide.

BACKGROUND AND SUMMARY OF THE INVENTION

Various release devices are utilized in archery and hunting to assist the user in pulling a bowstring to a fully drawn position and then releasing the bowstring to fire an arrow. Many of these devices include mechanical grippers that engage the bowstring directly, or that engage nock elements mounted on the bowstring. Other devices use rope looped about the bowstring as the release mechanism.

Examples of release devices may be found in my prior U.S. Pat. Nos. 5,680,851; 5,685,286; 5,937,842; and 5,694,915.

It is also known to use wrist straps or gloves connected to the release device to enhance control and accuracy of the release. Examples of such wrist straps may be found in U.S. Pat. Nos. 5,020,508; 4,981,128; 4,791,908; and 4,509,497.

In accordance with the present invention, an archery wrist strap and index finger trigger release is provided that is designed to provide a crisp minimal movement, no load trigger in a small compact package. The release incorporates a gun-type firing pin as well as a cocking slide. The release itself includes a two-piece release body assembly that includes a main body and a body or side cap that encloses and holds the internal components of the release within the interior of the main body. A shaft assembly extends rearwardly of the release and is connected to a wrist strap. The shaft length is adjustable so that the user can fit the strap and release to the hand in accordance with personal preference.

The internal components of the release include a pair of pivotably mounted jaws, a firing piston mounted for sliding movement within the main body, a firing pin assembly that slides within the piston; a firing ball; a cocking slide; a flip sear; a trigger, and three biasing springs, all of which are described in greater detail further below.

The pivotally mounted jaws are held in a closed (ready for firing) position by a spring-biased firing ball that prevents the jaws from opening prior to pulling the trigger. The firing ball is actuated by a firing pin assembly that is slidably mounted within a spring-biased piston. When fired, the firing pin moves the ball forwardly, allowing the jaws to open under force exerted by the bowstring. This aspect of the release is generally similar to the releases disclosed in my prior U.S. Pat. Nos. 5,685,286 and 5,680,851.

The cocking slide is slidably mounted within the main body, but externally accessible by the user. The cocking slide is engageable with the piston to push the piston rearwardly (against a spring bias) to a cocked position, with the pivotally mounted, spring biased sear holding the piston in the cocked position. The sear is also operatively connected to the trigger so that when cocked, the trigger prevents movement of the sear. When the trigger is pulled, the sear is caused to move away from the piston and thus release the piston. The piston and the firing pin assembly within the piston move forwardly under spring force, so that the firing pin engages the firing ball and pushes it forward (against another spring bias) to a position where the jaws are free to open and thus release the bowstring. The trigger is also adjustable for sensitivity of movement and pressure with a single set screw.

Thus, in accordance with one aspect, the invention provides a bowstring release comprising a main body portion; a pair of jaws pivotably mounted within the housing for movement between closed and open positions; a piston and firing pin assembly slidably mounted in the housing and biased in a firing direction by a first spring, the piston and firing pin assembly operatively connected to the jaws; a cocking slide mounted for sliding movement along a top surface of the housing, the cocking slide engageable with the piston for moving the piston to a cocked position; a sear pivotably mounted within the housing, one end of which is engageable with the piston; and a trigger pivotably mounted in the housing, the trigger having a projection engageable with an opposite end of the sear; the sear biased against the projection in a non-firing direction by a second spring; the projection, when the trigger is pulled, moving the sear in a firing direction to enable the one end to disengage the piston and thereby permit the piston and firing pin assembly to move forward in a firing direction to cause the jaws to move to the open position.

In accordance with another aspect, the invention relates to a bowstring release comprising a main body portion; a pair of jaws pivotably mounted within the main body portion for movement between open and closed positions; firing means mounted in the main body portion for moving the jaws from the closed position to the open position; means mounted in the main body portion for moving the firing means to a cocked position and for holding the firing means in: the cocked position and the jaws in the closed position; and trigger means mounted in the main body portion for releasing the firing means for movement that results in the jaws moving to the open position.

Other objects and advantages of the invention will become apparent from the detailed description that follows.

BRIEF DESCRIPTION OF THE DRAWINGS

FIG. 2 is a side elevation of the main body housing;

FIG. 3 is an end view of the housing illustrated in FIG. 2;

FIG. 4 is a plan view of the housing shown in FIG. 2;

FIG. 8 is a side elevation of a cocking slide incorporated in FIG. 1A and 1B;

FIG. 9 is an end view of the cocking slide shown in FIG. 8;

FIG. 10 is a bottom plan view of the cocking slide shown in FIG. 8;

FIG. 11 is a side elevation of the trigger incorporated in the release shown in FIGS. 1A and 1B;

FIG. 12 is a partial end view of the trigger shown in FIG. 11;

FIG. 13 is a side elevation of a flip sear incorporated in the release shown in FIGS. 1A and 1B;

FIG. 14 is an end view of the flip sear shown in FIG. 13;

FIG. 15 is a side elevation of a piston and firing pin assembly incorporated in the release shown in FIGS. 1A and 1B;

FIG. 16 is an end view of the piston shown in FIG. 15, but with the firing pin components omitted; and FIG. 17 is a plan view of the piston shown in FIG. 15, with the firing pin components omitted.

DETAILED DESCRIPTION OF THE DRAWINGS

Figure 1A:
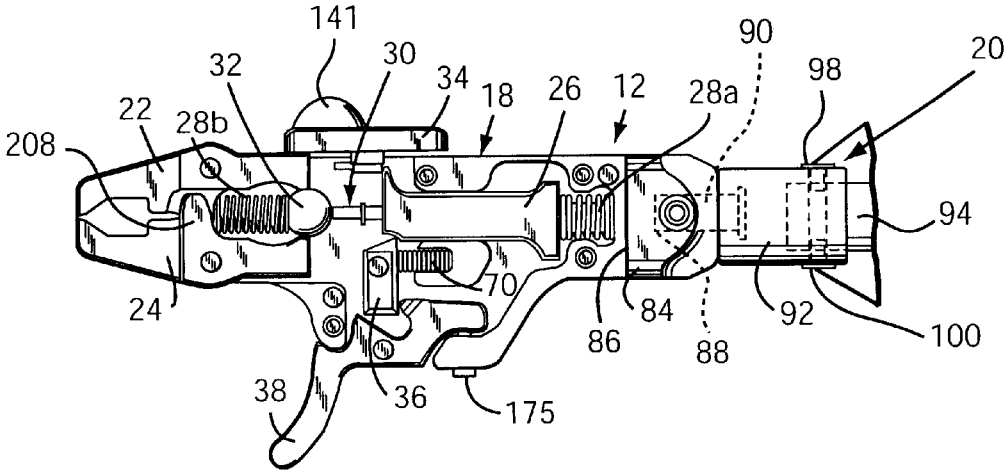
FIG. 1A is a side elevation of the release body, with the side cap removed to illustrate the internal components of the release, and with the release shown in a cocked position, with the jaws closed.
Figure 1B:
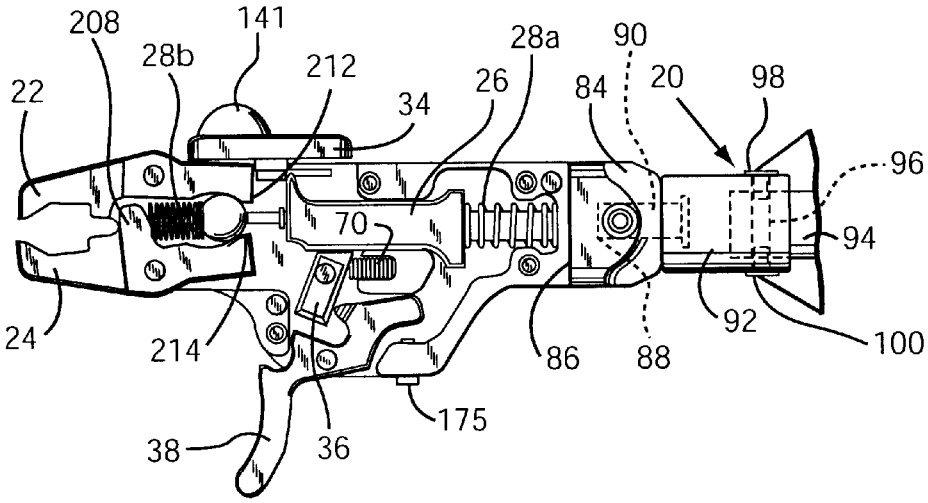
FIG. 1B is a side elevation similar to FIG. 1A, but with the release shown in a released or fired position, with the jaws open.
Figure 1C:
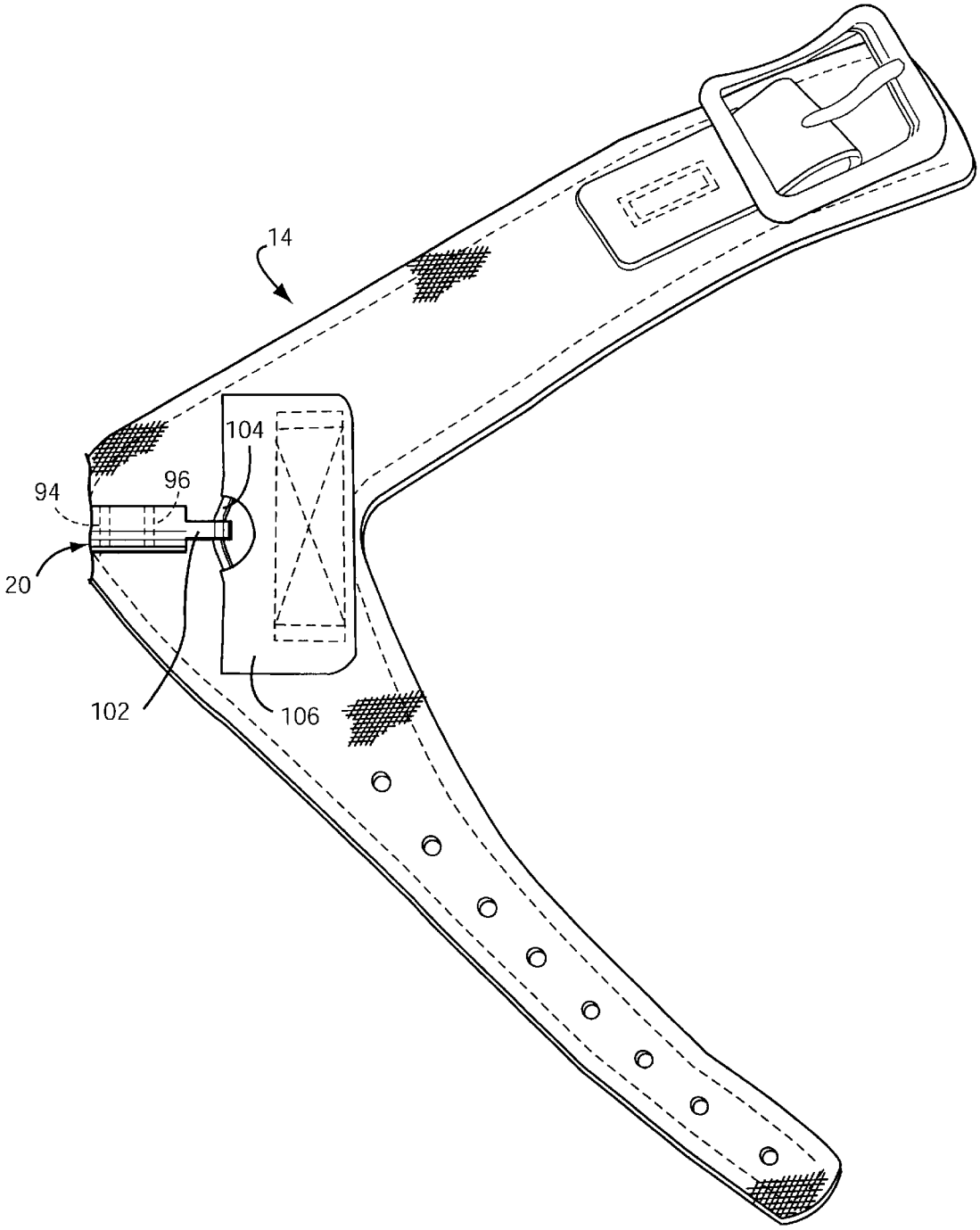
FIG. 1C is a plan view illustrating the wrist strap portion of the release.

FIGS. 1A–1C illustrate the wrist strap and index finger trigger release assembly 10 in accordance with an exemplary embodiment of the invention. FIGS. 1A and 1B show the release 12 in cocked and fired positions, respectively, while FIG. 1C shows the wrist strap 14. It will be appreciated that FIGS. 1A and 1B are shown in an enlarged scale relative to the wrist strap so that the various components in the release are more easily seen and understood.

Generally, the release 12 includes a two piece release body assembly that includes a main body housing or portion 16 and a body or side cap 18 along with an adjustable shaft assembly 20 by which the release is connected to the wrist strap 14. The main body 16 carries a pair of jaws 22, 24; a firing piston 26; associated piston springs 28 *a, b;* firing pin assembly 30; a firing ball 32; a cocking slide 34; a flip sear 36 (and associated spring 70) and a trigger 38. Each of the components and their respective functions will be discussed in more detail below.

Referring especially now to FIGS. 2, 3 and 4, the main body portion 16 is formed with a flat, forward side surface 40, into which has been press fit first and second hinge pins 42, 44 that pivotably carry the jaws 22, 24. Axially behind the pins 42, 44, there is an elongated axially extending groove 46, closed at its forward end and open at its rearward end. Immediately behind the flat surface 40, there is a slightly recessed, flat side surface 48, with surfaces 40 and 48 defining an interior side of the main body portion 18. A further recessed area 50 is formed along the top of surface 48, with a guide rail 52 having a top surface 54 that is co-planar with the top surface 56 of the release. Guide rail 52 cooperates with cocking slide 32 as discussed further herein. "Raised" (or laterally projecting) surface areas 58, 60 and 62 define substantially the thickness or width of the release, and are engaged by the body cap 18 when fully assembled. The raised area 58 carries a third pin 64 that locates the body cap 20, and also includes a threaded blind fastener hole 66 for use with a fastening screw as explained further herein.

The raised surface 60 is centrally located within the body interior and is formed with a forward facing recess 68 adapted to partially enclose and locate a third coil spring 70. A fourth pin 72 (a hinge pin) is located adjacent the forward end of recess 68 and pivotally mounts the flip sear 36, such that coil spring 70 biases the flip sear in a counter-clockwise direction about the pin 72. The raised area 62 includes surfaces 62(*a*), 62(*b*) and 62(*c*) that extend, respectively, along the top of the release, across the back of the release and along the bottom of the release. Blind screw fastener holes 74, 76 are spaced along the surface 62(*a*) of the release, and a fifth pin 78 (a locating pin) is located immediately behind and adjacent the fastener hole 76. Another screw fastener hole 80 is located along bottom surface 62(*c*), adjacent back surface 62(*b*).

A sixth pin 82 (or hinge pin) pivotably carries the trigger 38 and projects from surface 48 generally axially between the bottom surface 62(*c*) and the raised area 58.

The rearwardmost portion 84 of the release extends laterally the full width of the release, such that the body cap 18 engages transverse (forward facing) surface 86 as well as surfaces 62(*a*), (*b*) and (*c*) and 58 when assembled. The portion 84 is formed with a blind, axial bore 88 (see FIG. 2) in which is secured a rearwardly extending, flanged stud 90 that, in turn, mounts a shaft housing 92 for free rotation relative to the body 16. An adjustable shaft 94 extends from the housing 92 and is rotatable therewith. Shaft 94 is secured to the strap as discussed further herein. Note that shaft 94 is axially adjustable relative to the housing 92 in order to permit the user to adjust the position of the release relative to the wrist strap. To this end, shaft 94 is formed with axially spaced transverse holes 96 that are adapted to be engaged by locking set screws 98, 100 at diametrically opposed locations on the housing 92. The free end of shaft 94 is formed with an eye or loop 102 that receives a hinge pin 104 secured to the wrist strap by a doubled over and stitched pad 106.

Figure 5:
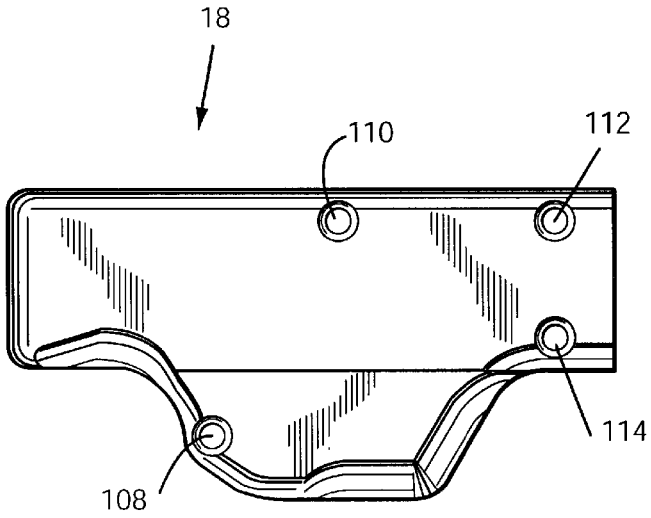
FIG. 5 is a side elevation of the body or side cap for the release mechanism.
Figure 6:
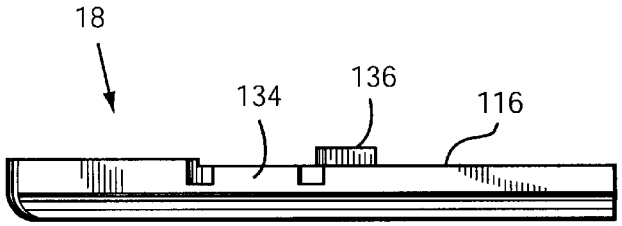
FIG. 6 is a plan view thereof.
Figure 7:
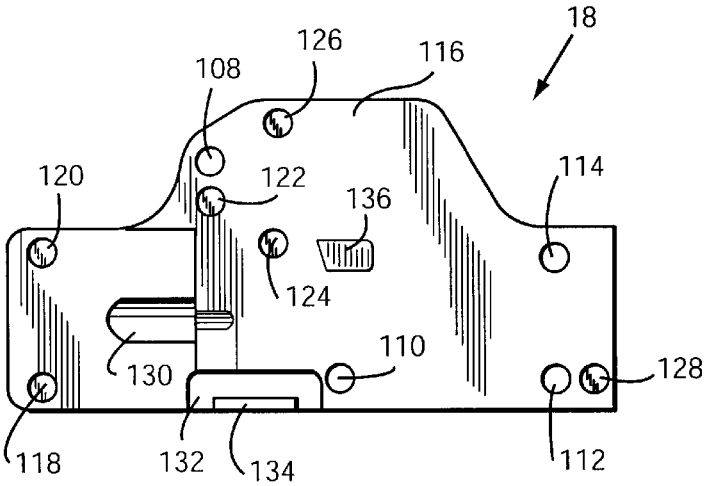
FIG. 7 is an opposite side elevation of the body or side cap shown in FIG. 6.

Turning now to FIGS. 5–7, the body side cap 18 comprises a substantially flat, thin cover piece formed with holes 108, 110, 112 and 114 that cooperate with threaded holes 66, 74, 76 and 80, respectively, on the main body 16 to thereby enable attachment of the cap 18 to the main body 16 by means of matching threaded screw fasteners. Cap 18 thus holds all of the above identified internal components within the release body. The interior side 116 of the cap 18 is formed with shallow, blind bores 118, 120, 122, 124, 126 and 128 that are located to align with and receive respective pins 42, 44, 64, 72, 82 and 78. The interior side 116 is also formed with an axially oriented groove 130 that is adapted to align and cooperate with the groove 46 in the main body, thus forming a two-sided groove in which the firing ball 32 travels; a recessed area 132 and guide rail 134 that align with and engage recessed area 50 and guide rail 52. A raised surface 136 is aligned to engage within the open slot 68 to thereby close one side of the slot and thus more closely confine the coil spring 70.

With reference to FIGS. 9–11, the cocking slide or lever 34 includes a generally rectangular and substantially flat finger button 138 with a top surface 140 and a bottom surface 142. Depending from the bottom surface 142 is a generally inverted T-shape guide 144 that includes a narrow neck portion 146 and a transverse tab 148 that extends beyond the neck 146 in laterally opposite directions as best seen in FIG. 10. The bottom surface 150 of the tab 148 is formed with an elongated transverse recess 152 for a purpose explained further below. The slide or lever 34 is adapted to slide along the top of the body portion, with guide rails 52 and 134 located in the side recesses 154, 156 created by the tab 148 and neck 146, and with the tab 148 located in the recesses 50, 132, below the guide rails 52 and 134. A rubber (or other suitable material) "button" 141 is fixed to the surface 140 by any suitable means to facilitate movement of the lever 34 as further described below. The cocking slide 34 is independent of any other parts, insuring that any contact with the cocking slide, after it is moved to the cocked position, will not cause unwanted piston release resulting in possible premature firing.

FIGS. 11 and 12 illustrate the trigger 38. The trigger is provided with a generally centrally located hole 158 by which the trigger is pivotably mounted via pin 82 to the main body 16. The trigger includes a curved finger grip 160 that extends downwardly and slightly forwardly relative to the release body. The trigger is shaped to cooperate with the interior surfaces in the main body, such that only limited pivoting movement is possible. For example, a forward cut-out portion 162 receives the lower portion of raised area 58, while a rearward cut-out 164 extends about a portion 166 of the lower surface 62(*c*). A tapered actuator tip 168 extends forwardly from a location just aft of the pivot hole 158, and is adapted to engage and release the flip sear 36 (in a manner to be described further herein), when the trigger is pulled to the rear in a counterclockwise direction. Main body surface 170 and 172 (FIG. 1B) engage corresponding surfaces 174, 176 and serve to limit the movement of the trigger, and a set screw 175 received in a bore in surface 62(*c*) is adapted to engage surface 162 so as to enable sensitivity adjustment of the trigger relative to the flip sear 36 to the extent of having no excess travel of the trigger prior to releasing the sear/piston.

FIGS. 13 and 14 illustrate the "flip" sear 36. This is a substantially rectangular block 178 with a transverse bore 180 by which the sear is pivotably mounted within the main body 16 via pin 72. Bore 180 is located toward the upper end of the block. The top of the block is formed with a wedge shaped "catch" or tab 182 with the thicker portion of the wedge forming a transverse locking edge 184 at the rearward end of the block. Edge 184 is adapted to cooperate with the drive piston as explained further below. A flat rear surface 186 is adapted to be engaged by the tip 168 of the trigger as also described further below.

The firing piston 16 and firing pin assembly 30 are shown in FIGS. 15–17.

Piston 16 is shaped generally in a rectangular block having a forward end 188 and a rearward end 190. The forward end is formed with an upstanding, tapered tab 192 that is received within the slot 152 on the underside of the cocking slide 34. The forward end 188 is also formed with a concave sear engagement notch 194 along a lower transverse edge thereof.

The piston 16 is also formed with a through bore 198 that receives the firing pin assembly 30. The latter consists of a forward firing pin 200 and a separate rearward dowel pin 202. The forward pin 200 is formed with a smaller diameter distal tip 204 and a radial flange 206 that limits the degree of relative movement between the pin 200 and the piston 16. Rearward dowel pin 202 has a constant diameter. The dowel pin maintains approximately 0.070 clearance of air space between the piston and firing pin flange, insuring no load-up of bow draw weight on the trigger.

Returning to FIGS. 1A and 1B, the release jaws 22, 24 are pivotably mounted and secured in the main body via hinge pins 42, 44, respectively, located in substantially axially centered positions along the lengths of the jaws. The jaws 22, 24 as shown are designed for use directly with a bowstring or standard bowstring nock. It will be appreciated that the jaws 22, 24 may be formed with generally semi-spherical sockets (or pairs of sockets) for engagement with a single (or double) ball nock as shown and described in my '851 and '286 patents. Adjacent the pivot or hinge pins 42, 44, the jaws are formed with transverse intermediate tabs 208 (one shown) that are adapted to be engaged by the forward end of spring 28*b*.

Transverse end tabs 212, 214 (FIG. 1B) at the rearward-most end of the jaws are adapted to be engaged by the ball 32 as further described below.

With reference especially to FIG. 1A, it can be seen that the cocking slide 34 has been moved to its rearward or cocking position. As the cocking slide is moved rearwardly, the piston 26 is also moved rearwardly against the bias of spring 28*a* until the transverse locking edge 184 of the sear 36 is received within the transverse groove 194 of the piston. Despite the bias of spring 70, the sear 36 is rendered immobile by the tapered actuator tip 168 of the trigger 38. In addition, the firing ball 32 is located between the end tabs 212, 214, that maintain the jaws 22, 24 in a closed position. The ball 32 is biased into this position by the coil spring 28*b*. Rearward movement of the ball is prevented by the piston pins 200, 202. In this cocked position, the piston and sear are independent of any outside influences of pressure, for example, differing amounts of bow draw weight.

With reference now to FIG. 1B, as the trigger 38 is pulled, the tapered actuator tip 168 moves forward, pivoting the sear 36 about the pivot pin 72, and against the bias of spring 70. As the transverse locking edge 184 slides past the transverse groove 194, the piston 26 is freed to move forwardly under the bias of spring 28*a*. As the piston moves forward, it engages the flange 206 on the firing pin 204, pushing the firing pin forwardly which in turn, pushes ball 32 forwardly against the bias of spring 28*b*. Jaws 22 and 24 are now free to open, primarily under the force imposed by the bowstring, but also due to the spring 28*b* pushing on transverse intermediate tabs 208.

With a new bowstring loaded between the jaws, the user pulls the cocking slide 34 rearwardly to the cocked position. In doing so, spring 28*b* pushes the ball 32 rearwardly to the position shown in FIG. 1A, closing the jaws about the bowstring. At the same time, the piston and firing pin assembly is moved rearwardly until the transverse groove 194 is engaged by the locking edge 184 of the sear, and with tip 168 of the trigger engaged with the sear (as shown in FIG. 1A). The release is then ready to be fired.

The sear 36 and piston 26 are preferably case hardened steel, plated or coated to prevent rust and provide lubrication.

As shown, jaws 22, 24 are adapted for use directly with a bowstring or a bowstring loop. It will be appreciated that jaws 22, 24 may also be shaped to engage single or double ball nocks, as shown in my '851 patent.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bowstring release comprising:

a main body portion;

a pair of jaws pivotably mounted within the housing for movement between closed and open positions;

a piston and firing pin assembly slidably mounted in said housing and biased in a firing direction by a first spring, said piston and firing pin assembly operatively connected to said jaws;

a cocking slide mounted for sliding movement along a top surface of the housing, the cocking slide engageable with the piston for moving the piston to a cocked position;

a sear pivotably mounted within the housing, one end of which is engageable with the piston; and a trigger pivotably mounted in said housing, said trigger having a projection engageable with an opposite end of said sear;

said sear biased against said projection in a non-firing direction by a second spring; said projection, when the trigger is pulled, moving the sear in a firing direction to enable said one end to disengage said piston and thereby permit the piston and firing pin assembly to move forward in a firing direction to cause said jaws to move to said open position.

2. The bowstring release of claim 1 wherein said piston includes a vertical tab received in a groove formed in an underside of said cocking slide.

3. The bowstring release of claim 2 wherein said main body portion includes guide grooves for said cocking slide.

4. The bowstring release of claim 2 wherein said vertical tab and said transverse recess are located at a forward face of said piston.

5. The bowstring release of claim 1 wherein said cocking slide mounts a rubber button to facilitate movement of the cocking slide to the cocked position.

6. The bowstring release of claim 1 wherein said sear comprises a substantially upright rectangular block, one end of which is formed with a wedge-shaped locking tab engageable with a transverse recess in a forward face of said piston.

7. The bowstring release assembly of claim 1 wherein said firing pin assembly includes a pair of pins slidably received in said piston.

8. The bowstring release assembly of claim 7 and further comprising a firing ball forward of said firing pin assembly and a third spring forward of said ball and engaged between said intermediate tabs and said jaws.

9. The bowstring release of claim 8 wherein said ball is interposed between said end tabs when the release is in the cocked position.

10. The bowstring release of claim 1 and further comprising a wrist strap connected to a rearward end of said main body portion.

11. The bowstring release of claim 10 including an adjustable shaft connecting said rearward end of said main body portion to said wrist strap.

12. The bowstring release of claim 11 wherein said main body portion is rotatable relative to said shaft and said wrist strap.

13. A bowstring release comprising:

a main body portion;

a pair of jaws pivotably mounted within the main body portion for movement between open and closed positions;

firing means mounted in said main body portion for moving the jaws from said closed position to said open position;

means mounted in said main body portion for moving said firing means to a cocked position and for holding said firing means in said cocked position and said jaws in said closed position; and trigger means mounted in said main body portion for releasing said firing means for movement that results in said jaws moving to said open position.

14. A bowstring release comprising:

a main body portion;

a pair of jaws pivotably mounted within the main body portion for movement between open and closed positions;

firing means mounted in said main body portion for moving the jaws from said closed position to said open position;

means mounted in said main body portion for moving said firing means to a cocked position and for holding said firing means in said cocked position and said jaws in said closed position; and trigger means mounted in said main body portion for releasing said firing means for movement that results in said jaws moving to said open position; and further comprising a wrist strap connected to a rearward end of said main body portion.

15. The bowstring release of claim 14 including an adjustable shaft connecting said rearward end of said main body portion to said wrist strap.

16. The bowstring release of claim 15 wherein said main body portion is rotatable relative to said shaft and said wrist strap.

* * * * *